United States Patent [19]

Poole

[11] Patent Number: 4,827,683

[45] Date of Patent: May 9, 1989

[54] CORNER POST FOR A BUILDING

[75] Inventor: William E. Poole, York, Pa.

[73] Assignee: Fypon, Inc., Stewartstown, Pa.

[21] Appl. No.: 220,319

[22] Filed: Jul. 18, 1988

[51] Int. Cl.[4] ..... E04F 19/02

[52] U.S. Cl. ..... 52/316 V; 52/278; 52/287; 52/316

[58] Field of Search ..... 52/282, 279, 555, 554, 52/276, 278, 519, 539, 288, 287, 541, 314, 316, 716

[56] References Cited

U.S. PATENT DOCUMENTS

| | | | |
|---|---|---|---|
| 1,463,041 | 7/1923 | Kalin | 52/716 |
| 2,342,682 | 2/1944 | Miller | 52/278 |
| 2,367,318 | 1/1945 | Tulloch | 52/541 |
| 2,373,789 | 4/1945 | Smith | 52/282 |

FOREIGN PATENT DOCUMENTS

| | | | |
|---|---|---|---|
| 1152 | of 1898 | United Kingdom | 52/541 |

*Primary Examiner*—John E. Murtagh

*Attorney, Agent, or Firm*—Scrivener and Clarke

[57] ABSTRACT

A corner post formed of two elongated members, which may be molded plastic, each member has a decorative ridge on the front face, a part of one ridge on one of the members lying along an edge thereof and defining a flange having an inner face which abuts an adjacent edge of the other member and covers the crack between the members. The ridge on the other member is spaced from its edge, the same distance as the first ridge is spaced from the front face of the other member. Additional symmetrically spaced ridges may also be provided.

7 Claims, 1 Drawing Sheet

CORNER POST FOR A BUILDING

This invention relates to buildings and more particularly to building corner posts of the type wherein two longitudinally extending members are assembled together in angular relationship to provide a finished appearance at the building corner, especially where the ends of siding material such as metal clapboard meet.

Metal clapboard, while having the appearance of wood, are hollow and require that the open ends at the building corners be closed against the passage of weather. One means for doing this is by the use of a vertical board at the side of each corner, the boards abutting each other along adjacent edges at the corner. The opposite edge of each board is provided with flanged edges to overlie the ends of the metal clapboards and sealant is inserted under the flanges to close the tapering gap between the inner surfaces of the flanges and the clapboard ends. No matter how the boards may abut along their edges at the corner, there is almost always a clear line or crack where the boards abut and this line can be difficult to seal.

The present invention provides a corner post composed of two longitudinally extending members wherein the side edge of one member abuts the rear face of the other member along its side edge. In order to cover the crack at the line of abutment, the first member is provided with a decorative ridge along its abutting edge, a part of the ridge being integral with the front face of the member and the remainder of the ridge extending perpendicularly to the side edges to define a flange whose inner face is adapted to abut the adjacent edge of the other member and in so doing cover the crack between the members. For the purpose of symmetry, the front face of the other corner member is also provided with an identical ridge spaced from the side edge of that member the same distance as the first mentioned ridge is spaced from the front face of the other member. The opposite ends of the two members are preferably flanged to overlie the ends of the exterior siding which may be metal clapboard. Thus not only is the crack covered, but to all appearances the corner post is of unitary construction having decorative, symmetrically located ridges on their respective front faces.

The principal object of the invention, therefore, is to provide a corner post of the foregoing nature.

Another object of the invention is to provide corner post members of the foregoing nature which are susceptible of ready fabrication by plastic molding.

Figure 1:
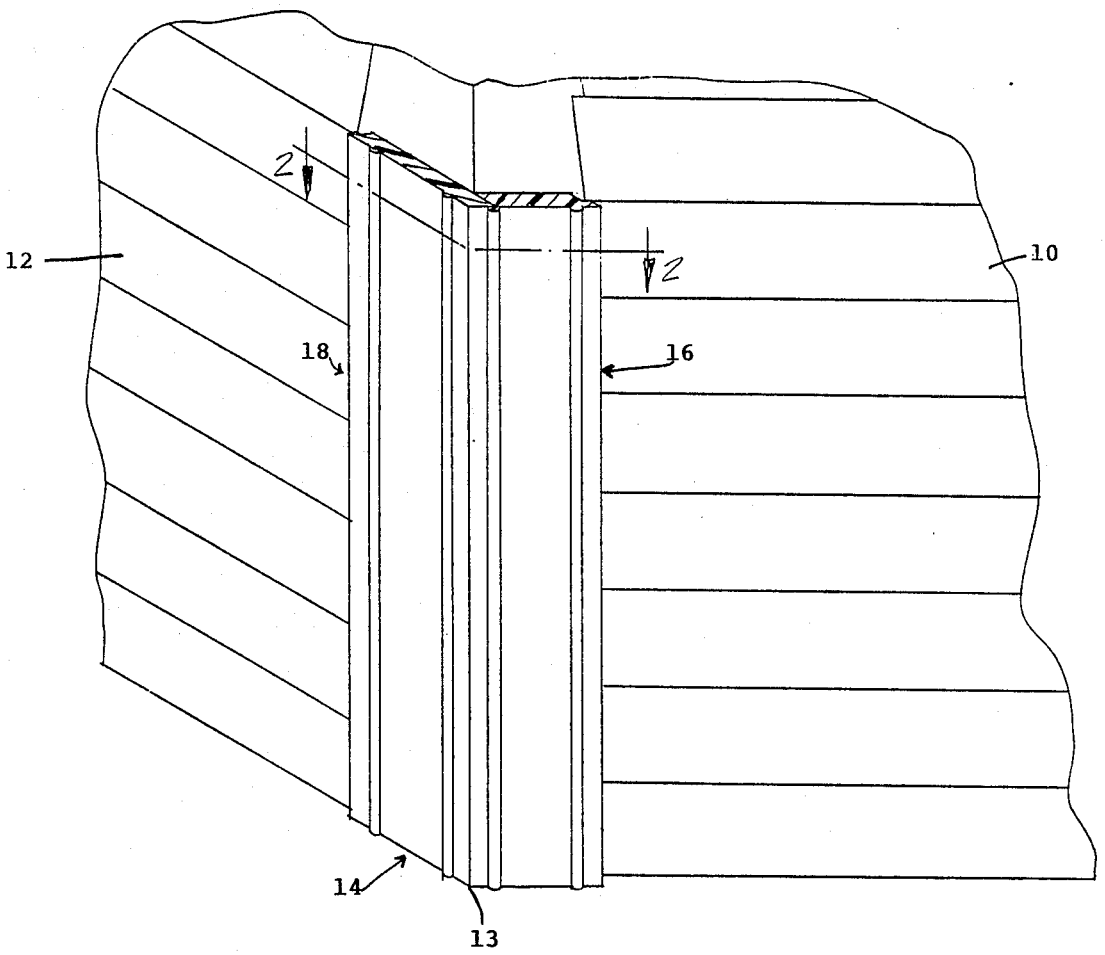
Figure 2:
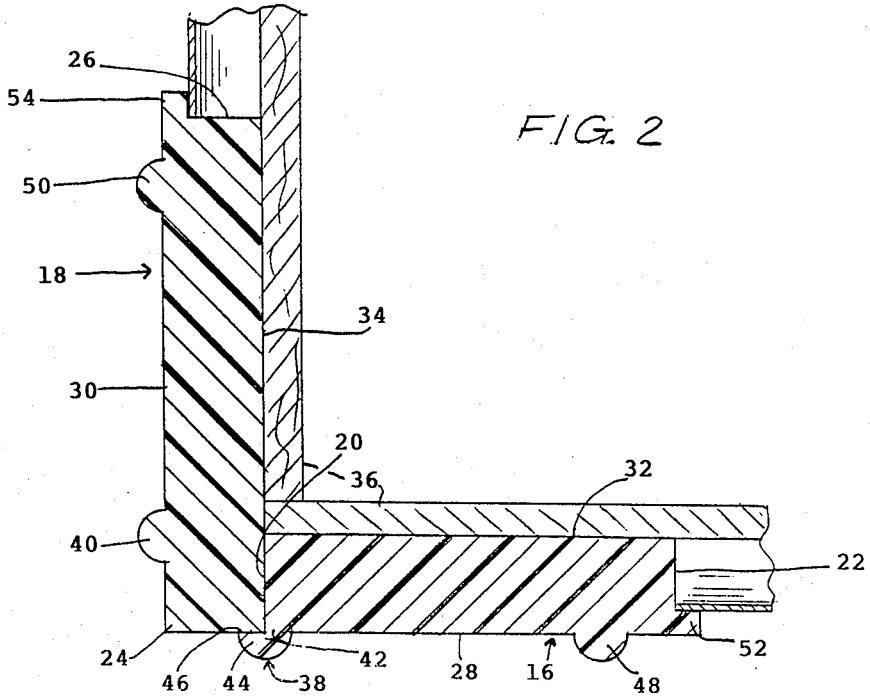

The foregoing and other objects will become apparent as the following detailed description is read in conjunction with the accompanying drawings wherein:

FIG. 1 is a perspective view, partially in cross-section, of a building corner incorporating the corner post of the present invention; and FIG. 2 is an enlarged broken horizontal cross sectional view taken substantially on the line 2—2 of FIG. 1.

Referring now to the drawings the numerals 10, 12 designate metal clapboards defining the exterior walls of the sides of a building which meet at a corner, generally designated by the numeral 13. The numeral 14 designates broadly a corner post constructed in accordance with the invention and comprising a pair of elongated members 16, 18 each having, respectively, a pair of side edges 20, 22, and 24, 26, a front face 28 and 30 adapted to be exposed to view, and a rear face 32 and 34 adapted to abut a substructure 36 at the corner of the building.

As can be seen, when the members 16, 18 are assembled together, the side edge 20 of member 16 abuts the rear face 34 of the member 18 adjacent the side edge 24 thereof. Each of the respective members 16, 18 has at least one decorative ridge 38, 40 on its front face 28, 30, and which may be of any desired cross-sectional shape such as the semi-circular shape shown.

In accordance with the invention, the ridge 38 on the front face 28 of member 16 lies along the first side edge 20 thereof. The ridge 38 has a part 42 which is integral with the front face 28 of member 16 and a part 44 extending perpendicularly of the side edge 20 to define therewith a rearwardly facing flange 46 which is adapted to overlie and engage the first side edge 24 of the other member 18.

In accordance with the invention and as can be seen, the ridge 40 on the other member 18 is located in substantially the same position with respect to the first side edge 24 of the member 18 as the ridge 38 on the first member 16 is with respect to the front face 30 of the member 18 when said members are in abutment with each other as in FIG. 2. With this arrangement it can be seen that the line of abutment or crack between side edge 20 of member 16 and the rear face 34 of member 18 is covered by the perpendicularly extending part 44 of the ridge 38 on the member 16. Further, the ridges 38, 40 on the respective members 16, 18 present the appearance of being symmetrically positioned relative to the corner of the building, that is to say, the ridges 38, 40 are spaced equi-distant from the apex of the corner.

Each of the members 16, 18 may be provided with one or more additional decorative ridges, such as the ridges 48, 50 shown, each of which is symmetrically positioned with respect to the respective other side edges 22, 26 of members 16, 18. If desired all of the ridges may be identical in appearance and at least one of the additional ridges on each face such as ridges 48, 50, may be positioned symmetrically with respect to the other side edges 22, 26 as the first ridges 38, 40 are positioned with respect to the first side edge 24 of the member 18 and with respect to the front face 30 of the member 18.

Desirably each of the respective other side edges 22, 26 of the members 16, 18 are rabbeted as shown to define flanges 52, 54 which are adapted to overlie the edges of exterior siding, such as the metal clapboards 10, 12 shown defining the outer walls of the building.

In accordance with an aspect of the invention, the members 16, 18 may comprise molded plastic material.

Having described the invention, what is claimed is:

1. A corner post for a building comprising a pair of elongated members adapted to engage each other in angular relationship at the corner of a building, each of said members having, respectively, a pair of side edges, a front face adapted to be exposed to view and a rear face adapted to abut sub-structure at the corner of a building, a first side edge of one member being adapted to abut the rear face of the other member adjacent a first side edge of said other member, each of said members having at least one longitudinally extending decorative ridge on its front face, said ridges being similar in appearance, the ridge on said one of said members lying along the first side edge thereof, said ridge having a part thereof integral with the front face of said member and a part thereof extending from said first side edge of said one member to define with said first side edge a rearwardly facing flange having an inner face adapted to overlie and engage said first side edge of said other member, the ridge on the other of said members being located in substantially the same position with respect to the first side edge of said other member as the ridge on the first member is positioned relative to the front face of said other member when said members are in abutment with each other whereby the line of abutment of said one member with the other is covered by the extending part of the ridge on said one member, and the ridges on the respective members present the appearance of being symmetrically positioned on the front faces of the respective members relative to the corner of a building when said members are installed in their positions of use defining a corner post for said building.

2. The corner post for a building as claimed in claim 1, including at least one additional decorative ridge on the front faces of the respective members each being symmetrically positioned with respect to the other side edge of each of said members.

3. The corner post of a building as claimed in claim 2, wherein all of the ridges on the front faces of both members are substantially identical in appearance.

4. The corner post for a building as claimed in claim 2, wherein the at least one additional ridge on each front face is positioned symmetrically with respect to the second side edge as the first ridges are positioned with respect to the corner defined by said members when in their position of use.

5. The corner post for a building as claimed in claim 1, wherein each of said other side edges of the respective members is rabbeted to define flanges adapted to overlie the edges of exterior siding defining the outer walls of a building.

6. The corner post for a building as claimed in claim 1, wherein said members are of plastic moldings of indeterminate lengths.

7. A corner post for a building comprising a pair of elongated members adapted to engage each other in angular relationship at the corner of a building, each of said members having, respectively, a pair of side edges, a front face adapted to be exposed to view and a rear face adapted to abut substructure at the corner of a building, one of said members having a part of predetermined shape extending from the front face along one side edge and adapted, when said members are in their position of use, to overlap a portion of a side edge of the other member and be spaced a predetermined distance from the plane of the front face of said other member, and said other member having a part on the front face thereof shaped to have the same appearance as said overlapping part and so located that when said members are in their positions of use, it is spaced from the plane of the front face of said one member substantially the same predetermined distance as said overlapping part is spaced from the plane of the front face of said other member.

* * * * *